United States Patent [19]

Rush, II et al.

[11] Patent Number: 5,054,456

[45] Date of Patent: Oct. 8, 1991

[54] FUEL INJECTION

[75] Inventors: William B. Rush, II, Clarkston; Jack E. Elder, Rochester, both of Mich.

[73] Assignee: General Motors Corporation, Detroit, Mich.

[21] Appl. No.: 432,030

[22] Filed: Nov. 6, 1989

[51] Int. Cl.[5] ..... F02M 23/00; F02M 55/02

[52] U.S. Cl. ..... 123/531; 123/470; 261/360; 239/600

[58] Field of Search ..... 123/472, 531, 533, 585, 123/590; 239/585, 600, 533; 261/36 A

[56] References Cited

U.S. PATENT DOCUMENTS

| | | | |
|---|---|---|---|
| 2,833,260 | 5/1958 | Dolza et al. | 123/119 |
| 2,837,073 | 6/1958 | Dolza | 123/122 |
| 2,843,096 | 7/1958 | Dolza et al. | 123/119 |
| 2,860,616 | 11/1958 | Dermond | 123/119 |
| 2,860,617 | 11/1958 | Pringham | 123/119 |
| 2,860,859 | 11/1958 | Dolza | 261/78 |
| 2,862,489 | 12/1958 | Pringham | 123/119 |
| 2,874,944 | 2/1959 | Dolza | 261/36 |
| 2,893,365 | 7/1959 | Haefner | 123/119 |
| 2,911,203 | 11/1959 | Kolbe | 261/37 |
| 2,913,235 | 11/1959 | Case | 261/78 |
| 2,914,051 | 11/1959 | Dolza et al. | 123/119 |
| 2,957,464 | 10/1960 | Dolza | 123/119 |
| 2,968,473 | 1/1961 | Mick | 261/23 |
| 2,991,776 | 7/1961 | Dolza et al. | 123/119 |
| 3,181,519 | 5/1965 | Dolza | 123/119 |
| 3,943,904 | 3/1976 | Byrne | 123/139 AW |
| 4,054,621 | 10/1977 | Bubniak et al. | 261/46 |
| 4,132,203 | 1/1979 | Elpern et al. | 123/139 AW |
| 4,142,683 | 3/1979 | Casey et al. | 239/585 |
| 4,153,014 | 5/1979 | Sweet | 123/32 EA |
| 4,204,507 | 5/1980 | Casey et al. | 123/139 AW |
| 4,325,341 | 4/1982 | Yamauchi et al. | 123/472 |
| 4,347,822 | 9/1982 | Casey | 123/445 |
| 4,372,271 | 2/1983 | Elpern et al. | 123/445 |
| 4,429,674 | 2/1984 | Lubbing | 123/531 |
| 4,446,837 | 5/1984 | Elpern | 123/460 |
| 4,475,486 | 10/1984 | Kessler | 123/52 M |
| 4,519,370 | 5/1985 | Iwata | 123/432 |
| 4,621,772 | 11/1986 | Blythe et al. | 239/585 |
| 4,646,974 | 3/1987 | Sofianek et al. | 239/585 |
| 4,699,323 | 10/1987 | Rush et al. | 239/585 |
| 4,708,117 | 11/1987 | Mesenich | 123/531 |
| 4,794,901 | 1/1989 | Hong et al. | 123/533 |

FOREIGN PATENT DOCUMENTS

3241679C2 11/1982 Fed. Rep. of Germany .

OTHER PUBLICATIONS

Chevrolet Motor Division, General Motors Corporation; "Chevrolet Fuel Injection Shop Manual"; pp. 1, 6–14; 1956; Detroit, MI.

Engineering Product Information Department, Chevrolet Engineering Center, General Motors Corporation; "The Chevrolet Ramjet Fuel Injection System"; pp. 1–9; Oct. 1956; Detroit, MI.

John Dolza, E. A. Kehoe, Donald Stoltman, Zora Arkus-Duntov, "The General Motors Fuel Injection System"; SAE Preprint #16, pp. 2–7, 11–12, 19–24; Jan. 1957; Detroit, MI.

*Primary Examiner*—Carl Stuart Miller

*Attorney, Agent, or Firm*—Gordon F. Belcher

[57] ABSTRACT

A fuel injection assembly for an engine comprises a fuel injector having an injector outlet and a nozzle having a nozzle passage with a nozzle inlet and outlet. The nozzle passage includes a converging portion adjacent the nozzle inlet and a diverging portion adjacent the nozzle outlet. The fuel injection assembly further comprises a nozzle support for attaching the nozzle to the fuel injector so that the injector outlet registers with the nozzle passage adjacent the nozzle inlet enabling injection of fuel from the fuel injector into the nozzle passage. The nozzle has a nozzle port adjacent the nozzle inlet enabling the establishment of an air flow which enters the nozzle passage adjacent the nozzle inlet and exits the nozzle passage through the nozzle outlet. At least a portion of the air flow in the nozzle passage is sonic enabling the fuel injected into the nozzle passage to mix with the sonic air flow and be carried by it through the nozzle passage and the nozzle outlet.

18 Claims, 2 Drawing Sheets

FUEL INJECTION

TECHNICAL FIELD

This invention relates to components associated with a fuel injector of an engine, and more particularly, to a nozzle assembly for directing the fuel exiting the injector through a nozzle and for producing a sonic air flow in the nozzle.

BACKGROUND

A fuel injector is sometimes equipped with a nozzle positioned adjacent its outlet so that the fuel exiting the injector flows through a passage in the nozzle. Air can also be fed into the nozzle passage in addition to the fuel. The nozzle passage can be shaped and the pressure drop of the air through the nozzle can be controlled so that the air flowing through it achieves a sonic velocity resulting in the formation of a shock wave in the nozzle. The passage of the fuel through the shock wave increases the atomization of the fuel. This facilitates mixing of the fuel with the air prior to entering the cylinders of the engine and reduces the possibility of fuel condensing in the intake system after exiting the nozzle.

Numerous problems are associated with the use of such a nozzle. If the nozzle is not accurately aligned with respect to the fuel injector, the fuel exiting the injector can impinge on the walls of the nozzle passage. Contact between the fuel and the walls of the nozzle passage can result in fuel condensing in the nozzle passage making fuel atomization more difficult. In addition, impingement of the fuel on the walls of the nozzle passage can introduce turbulence resulting in a less predictable flow through the nozzle. Moreover, contact between the fuel and the walls of the nozzle passage can cause a reduction in the velocity of the fuel in the nozzle due to friction between the fuel and the nozzle thereby inhibiting fuel atomization, and mixing of the fuel and air.

Air can be provided to the nozzle through an air passage which feeds the nozzle through a single port. The port is typically formed in the wall of the nozzle so that the direction of the air flow into the nozzle is generally transverse to the direction of the fuel flow in the nozzle. The air stream entering the nozzle can direct the fuel toward the walls of the nozzle passage increasing the likelihood of fuel impingement on them. Moreover, the air passage leading to the port can have a perpendicular orientation with respect to the nozzle passage to further direct the air entering the nozzle passage squarely toward its wall opposite the port.

A further problem associated with such a nozzle is that the end from which the fuel exits is often blunt resulting in the fuel passing a generally flat surface upon exiting from the nozzle. Such a surface can be a prime site for fuel condensation.

SUMMARY OF THE INVENTION

The present invention provides a fuel injection assembly for an engine comprising a fuel injector having an injector outlet and a nozzle having a nozzle passage with a nozzle inlet and outlet. The nozzle passage includes a converging portion adjacent the nozzle inlet and a diverging portion adjacent the nozzle outlet. The fuel injection assembly further comprises a nozzle support for attaching the nozzle to the fuel injector so that the injector outlet registers with the nozzle passage adjacent the nozzle inlet enabling injection of fuel from the fuel injector into the nozzle passage. The direct connection of the nozzle to the fuel injector facilitates alignment of the nozzle passage with respect to the injector outlet thereby reducing the likelihood of impinging on the walls of the nozzle passage.

The nozzle has a nozzle port adjacent the nozzle inlet enabling the establishment of an air flow which enters the nozzle passage adjacent the nozzle inlet and exits the nozzle passage through the nozzle outlet. At least a portion of the air flow in the nozzle passage is sonic enabling the fuel injected into the nozzle passage to mix with the sonic air flow and be carried by it through the nozzle passage and the nozzle outlet. Mixing of the fuel with the sonic air flow increases the atomization of the fuel resulting in increased mixing of the fuel with the air.

The nozzle may have a plurality of nozzle ports equally spaced around its circumference enabling air to enter the nozzle passage from opposing directions. This reduces the resultant transverse velocity of the air in the nozzle and the associated deflection of the fuel toward the walls of the nozzle passage by the air.

The fuel injection assembly may be supported in a socket in the engine so that a cavity is formed around the nozzle ports. A cavity inlet is formed in the engine which allows air to flow into the cavity. The air flow diffuses in the cavity resulting in a reduction in its velocity before it flows through the nozzle ports into the nozzle. In addition, the axis of the cavity inlet may be oblique with respect to the axis of the nozzle passage resulting in a further reduction of the transverse velocity of the air entering into it.

The thickness of the nozzle adjacent its outlet may be reduced to diminish the area at this site available for fuel condensation.

These and other features and advantages of the invention will be more fully understood from the following description of certain specific embodiments of the invention taken together with the accompanying drawings.

BRIEF DRAWING DESCRIPTION

In the drawings.

Corresponding reference characters indicate corresponding parts throughout the several views of the drawings.

DETAILED DESCRIPTION

Figure 1:
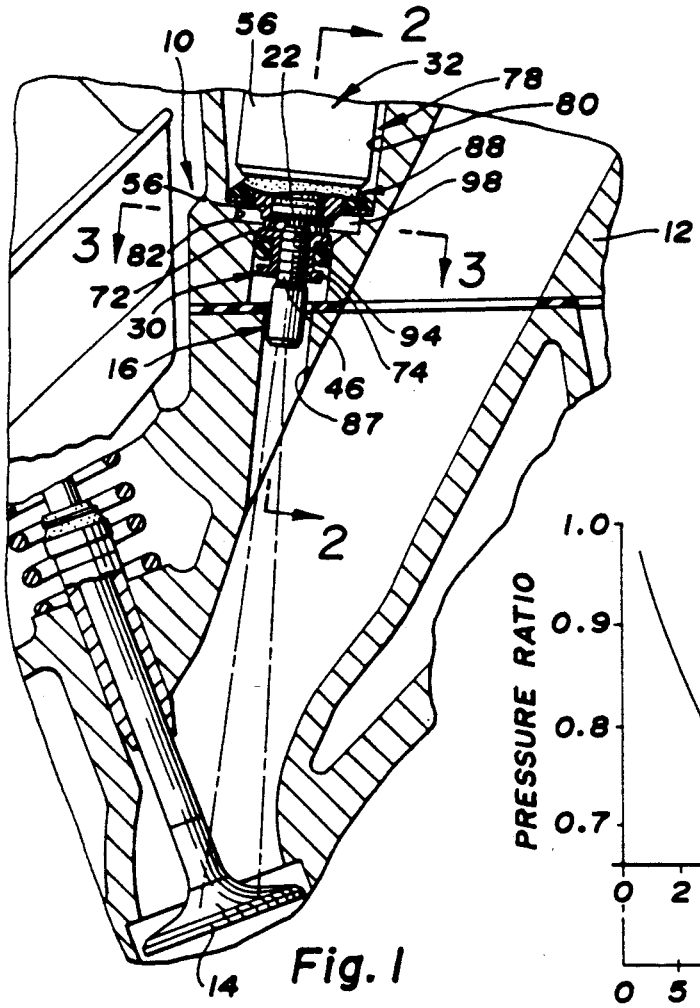
FIG. 1 is a vertical sectional view of a fuel injection assembly in accordance with the present invention mounted in an engine adjacent the intake valve.

Referring now to the drawings in detail, numeral 10 generally indicates a fuel injection assembly of the present invention mounted in an engine 12 adjacent an intake valve 14, as shown in FIG. 1. Briefly, the fuel injection assembly 10 comprises a fuel injector 32 having an injector outlet 34, and a nozzle 16 having a nozzle passage 18 with a nozzle inlet 22 and nozzle outlet 26. The nozzle passage 18 includes a converging portion 20 adjacent the nozzle inlet 22 and a diverging portion 24 adjacent the nozzle outlet 26.

The fuel injection assembly 10 includes a nozzle support 30 for attaching the nozzle 16 to the fuel injector 32 so that the injector outlet 34 registers with the nozzle passage 18 adjacent the nozzle inlet 22 enabling injection of fuel from the fuel injector into the nozzle passage. The nozzle 16 has a nozzle port 28 adjacent the nozzle inlet 22 enabling the establishment of an air flow which enters the nozzle passage 18 adjacent the nozzle inlet and exits the nozzle passage through the nozzle outlet 26. At least a portion of the air flow in the nozzle passage 18 is sonic enabling the fuel injected into the nozzle passage to mix with the sonic air flow and be carried by it through the nozzle passage and the nozzle outlet 26.

Figure 5:
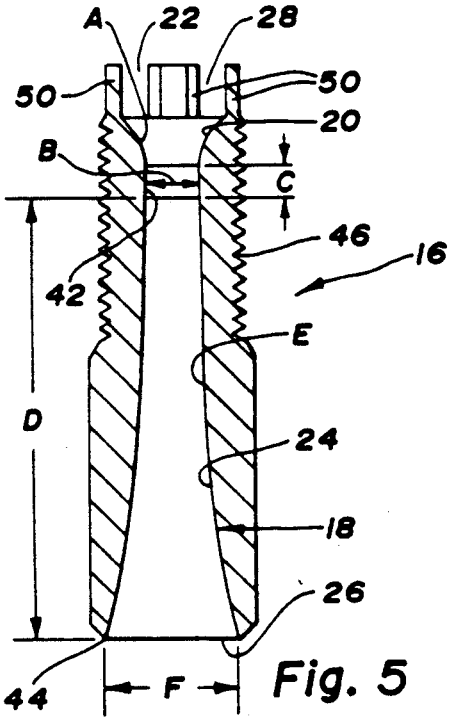
FIG. 5 is an enlarged cross sectional view generally in the plane indicated by line 5—5 of FIG. 2 showing the nozzle with the adjacent parts removed and showing the dimensions of the test nozzle.
Figure 6:
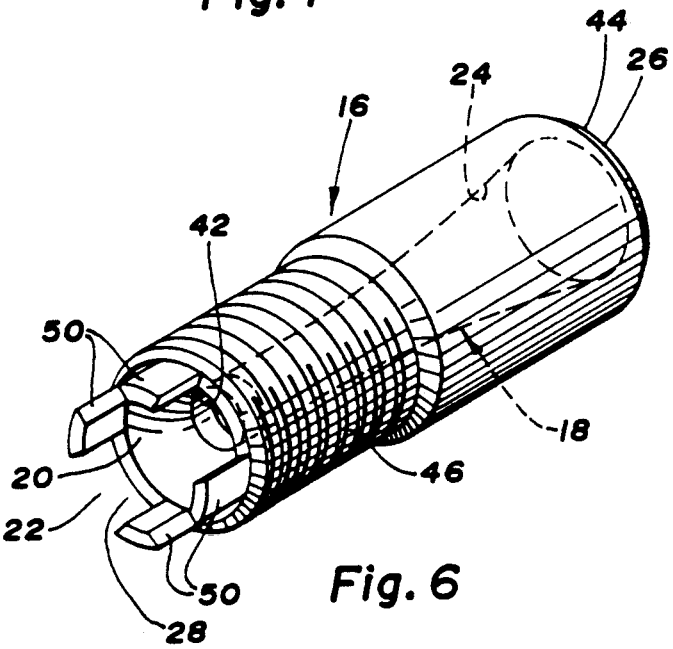
FIG. 6 is an enlarged perspective view of the nozzle of FIG. 5 showing the nozzle passage (in broken lines)

More specifically, the nozzle 16 comprises a generally cylindrical member through which the nozzle passage 18 extends, as shown in FIGS. 5 and 6. The converging portion 20 adjoins the nozzle ports 28 and the diverging portion 24 adjoins the nozzle outlet 26. The nozzle passage 18 has a throat 42 which has a generally uniform cross section between the converging and diverging portions 20, 24. Inclusion of the throat 42 results in separation of the minimum cross sections of the converging and diverging portions 20, 24 to facilitate their manufacture. The nozzle 16 is chamfered adjacent the nozzle outlet 26, as shown in FIG. 5, so that an outlet edge 44 is formed.

The portion of the nozzle 16 adjacent the nozzle inlet 22 has external threads 46 corresponding to internal threads 48 in the nozzle support 30. This enables the nozzle 16 to be screwed into the nozzle support 30, as shown in FIG. 2.

Figure 3:
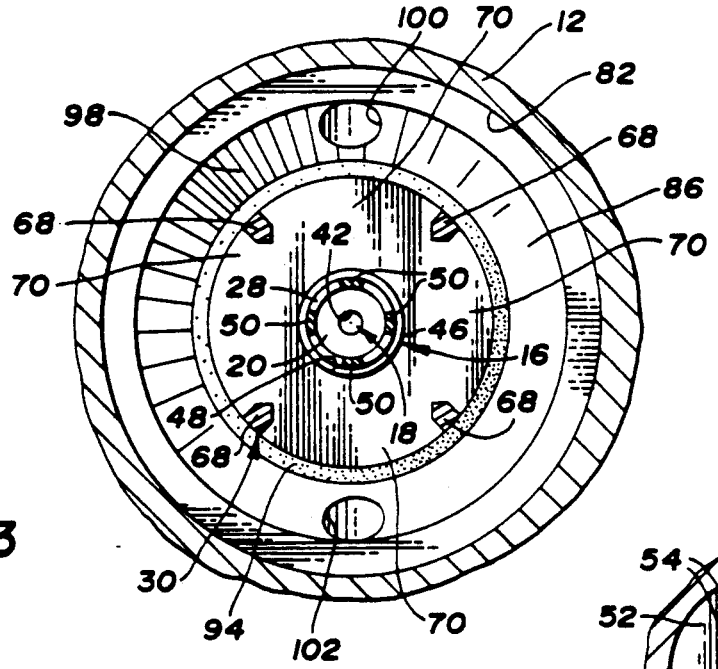
FIG. 3 is a portion of an enlarged cross sectional view generally in the plane indicated by line 3—3 of FIG. 1 showing the nozzle, nozzle support and socket.

The nozzle 16 has four equally spaced integral nozzle legs 50 adjacent the nozzle inlet 22, as shown in FIGS. 3 and 6. As shown in FIG. 2, the ends of the nozzle legs 50 abut a director plate 52 contained within the lower housing 56 of the fuel injector 32. The contact between the ends of the nozzle legs 50 and the director plate 52 results in the formation of four longitudinal slots, constituting the nozzle ports 28, between the nozzle legs enabling air to enter the nozzle passage 18.

Figure 4:
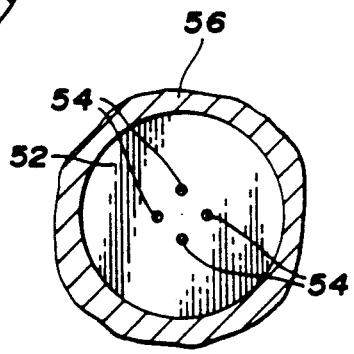
FIG. 4 is a portion of an enlarged cross sectional view generally in the plane indicated by line 4—4 of FIG. 2 showing the director plate.
Figure 2:
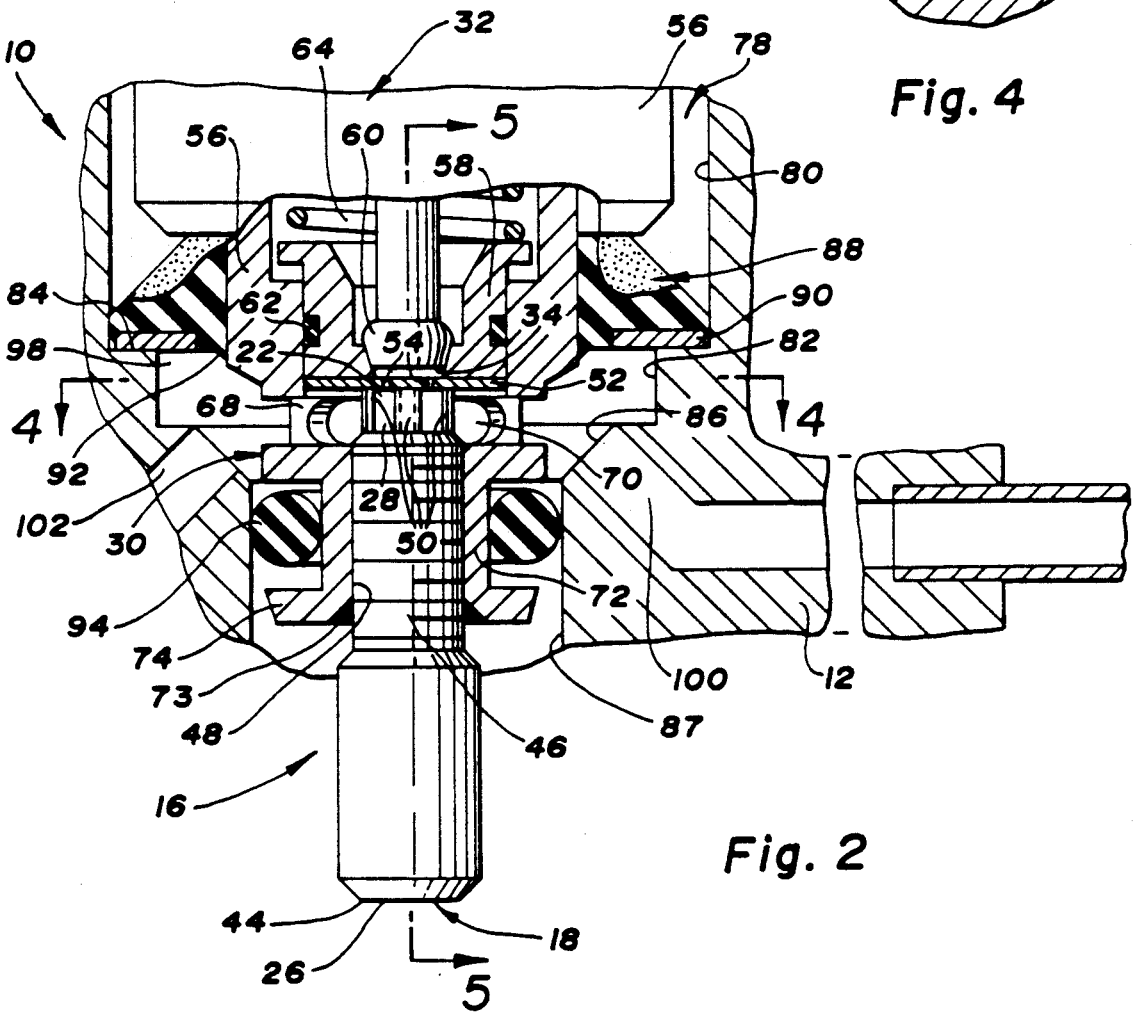
FIG. 2 is a portion of an enlarged cross sectional view generally in the plane indicated by line 2—2 of FIG. 1 showing the fuel injection assembly in detail.

As shown in FIG. 2, the director plate 52 is oriented in a generally perpendicular relation with respect to the axis of the nozzle passage 18. The director plate 52 has four fuel passages 54 shown in FIG. 4 which are slanted inward toward the longitudinal axis of the nozzle passage 18. The fuel passages 54 are oriented so that their axes intersect in the throat 42. A cylindrical valve seat element 58 is contained within the lower housing 56 above the director plate 52. An injector valve 60 is seated within the valve seat element 58 to control the flow of fuel out of the injector outlet 34. An O-ring 62 is seated between the valve seat element 58 and the lower housing 56.

A spring 64 is positioned within the lower housing 56 to urge the valve seat element 58 against the director plate 52 and urge the director plate against the nozzle legs 50. This results in generally flush contact between the director plate 52 and the ends of the nozzle legs 50.

The nozzle support 30 includes an integral cylindrical flange extending downward from the lower housing 56 as shown in FIG. 2. The nozzle support 30 has an inlet portion 68 surrounding the nozzle legs 50. The inner radial dimension of the inlet portion 68 is greater than the outer radial dimension of the nozzle 16 adjacent the nozzle inlet 22, as shown in FIG. 3. The inlet portion 68 has flange ports 70 comprising four equally spaced circumferential slots which may be offset from the nozzle ports 28, as shown in FIG. 3.

The nozzle support 30 includes an integral threaded portion 72 adjacent the lower end of the inlet portion 68, as shown in FIG. 2. The internal threads 48 are formed on the inner surface of the threaded portion 72. After the nozzle 16 is screwed into the threaded portion 72 and aligned with respect to the injector outlet 34, weld beads 73, shown in FIG. 2, are made between the nozzle and the end of the threaded portion to maintain the alignment. Preferably, two weld beads 73 are made in generally diametrically opposite locations.

The fuel injector 32 is supported within a socket 78 formed in the engine 12 generally above the intake valve 14. The fuel injector 32 is seated in the socket 78 so that the fuel exiting the nozzle outlet 26 is directed toward the intake valve 14, as shown in FIG. 1. As shown in FIG. 2, the socket 78 includes a cylindrical support portion 80 above a cylindrical port portion 82. The diameter of the port portion 82 is less than the support portion 80 resulting in the formation of a ledge 84 between them, as shown in FIG. 2. The socket 78 also includes a tapered portion 86 below the port portion 82. The tapered portion 86 registers with a cylindrical outlet passage 87 which leads to the intake valve 14.

A resilient seal ring 88 is positioned between the support portion 80 and the lower housing 56 adjacent the support ledge 84, as shown in FIG. 2. The seal ring 88 has an annular metal plate 90 formed in its lower surface which rests on the support ledge 84. The plate 90 stiffens the seal ring 88 to provide support to the fuel injector 32. The upper surface of the seal ring 88 is tapered to engage a beveled portion of the lower housing 56. The seal ring 88 has an integral annular lip 92 extending inward adjacent its lower surface to facilitate sealing between it and the lower housing 56. The fuel injector 32 is further supported by the connection of its upper portion to the engine 12.

An O-ring 94 is located between the threaded portion 72 and the walls of the outlet passage 87. The nozzle support 30 has an integral retaining portion 74 adjacent its lower end to retain the O-ring 94 between the threaded portion 72 and the walls of the outlet passage 87.

The radial dimensions of the port portion 82 and tapered portion 86 are larger than the inlet portion 68 enabling the formation of an annular cavity 98 adjacent the flange ports 70. The cavity 98 is defined by the seal ring 88, port and tapered portions 82, 86, the upper part of the outlet passage 87, and the O-ring 94, as shown in FIGS. 2 and 3.

A cavity inlet 100 shown in FIGS. 2 and 3 comprises a passage formed in the engine 12 to allow air to flow into the cavity 98. The cavity inlet 100 is oblique with respect to the axis of the nozzle passage 18.

A cavity outlet 102 shown in FIGS. 2 and 3 comprises a passage formed in the engine 12 to allow air to flow out of the cavity 98. The cavity outlet 102 is on a generally opposite side of the cavity 98 from the cavity inlet 100 and is oblique with respect to the axis of the nozzle passage 18.

Operation

In operation, air is drawn from the cavity 98 and fuel is drawn from the fuel injector 32, through the nozzle 16 and past the intake valve 14 into the cylinder. This air flow is produced by the vacuum in the cylinder caused by the intake stroke of the piston.

More specifically, air flows into the cavity 98 through the cavity inlet 100 shown in FIG. 2. Due to the orientation of the cavity inlet 100, the transverse velocity of the air with respect to the nozzle passage 18 is reduced as compared to its transverse velocity if the cavity inlet were perpendicular to the nozzle passage. The orientation of the cavity inlet 100 causes the air entering the cavity 98 to impinge upon the lower housing 56 and the adjacent part of the inlet portion 68 prior to passing through the flange ports 70. This creates turbulence within the cavity 98 which interferes with transverse air flows further reducing the transverse velocity of the air.

The air flow diffuses inside the cavity 98 causing a reduction in the velocity of the air prior to its entering the flange ports 70. Moreover, the air inside the cavity 98 circulates circumferentially around the outer surface of the inlet portion 68 shown in FIGS. 2 and 3 resulting in a generally uniform flow of air inward through the flange ports 70. The excess air inside the cavity 98 which does not flow through the flange ports 70 exits the cavity through the cavity outlet 102 to supply another engine component, such as a similar fuel injection assembly, or an air reservoir.

After flowing from the cavity 98 through the flange ports 70, the air continues to flow inward through the nozzle ports 28 into the nozzle passage 18. The radial air streams produced by the air flowing through the flange ports 70 can be diverted by the nozzle legs 50 prior to their passage through the nozzle ports 28 if there is an offset between the flange ports and the nozzle ports as shown in FIG. 3. This can result in a further reduction in the transverse velocity of the air.

The equal spacing of the nozzle ports 28 with respect to the circumference of the nozzle 16 results in the nozzle ports generally opposing one another. Each air stream entering the nozzle passage 18 through a respective nozzle port 28 therefore generally opposes the air stream entering the nozzle passage from the opposite nozzle port. This reduces the overall transverse velocity of the air entering the nozzle passage 18.

The air flows through the nozzle passage 18 toward the nozzle outlet 26. A sonic air flow is produced in the nozzle passage 18 when the air pressure adjacent the nozzle outlet 26 is at least approximately 5.95 in. (15.1 cm) Hg. below the air pressure adjacent the nozzle inlet 22. The sonic air flow in the nozzle passage 18 results in the formation of a shock wave in the throat 42. Operation of the nozzle 16 with the air pressure adjacent the nozzle outlet 26 lower than approximately 5.95 in. (15.1 cm) Hg. below the air pressure adjacent the nozzle inlet 22 does not affect the existence of the shock wave and has little effect on the mass flow rate of air through the nozzle passage 18.

The injector valve 60 shown in FIG. 2 is periodically lifted off the valve seat element 58 to allow fuel to be drawn through the injector outlet 34 and fuel passages 54 into the nozzle passage 18. The orientation of the fuel passages 54 with respect to the nozzle passage 18 results in the fuel flowing into the center of the nozzle passage away from its walls. The deflection of the fuel toward the walls of the nozzle passage 18 by the air is diminished by the reduced transverse velocity of the air entering the nozzle passage 18. The atomization of the fuel flowing through the nozzle passage 18 is substantially increased by its passage through the shock wave.

The fuel and air exit the nozzle 16 through the nozzle outlet 26 and pass the outlet edge 44. The formation of the outlet edge 44 reduces condensation of the fuel since the area of the nozzle 16 adjacent the nozzle outlet 26 available for condensation is diminished. After exiting the nozzle 16, the air and fuel flow through the outlet passage 87 toward the intake valve 14 shown in FIG. 1.

As a specific example, tests were conducted on a test nozzle having the dimensions shown in FIG. 5. The wall of the converging portion 20 had a radius of 5.0 mm. The throat 42 had a diameter of 1.27 mm and an axial length of 0.635 mm. The diverging portion 24 had an axial length of 11.7 mm and a wall radius of 87.431 mm. The diameter of the nozzle outlet 26 was 2.84 mm.

Figure 7:
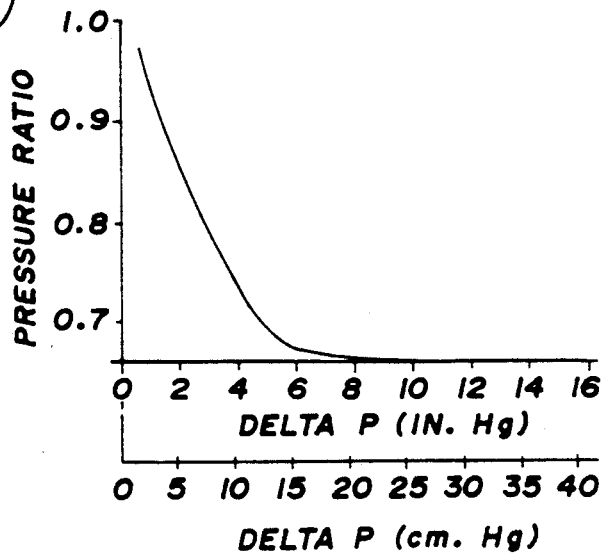
FIG. 7 is a graph illustrating the pressures required to produce sonic and supersonic air flows through the test nozzle of FIG. 5.

The results from the testing conducted on the test nozzle 16 are shown in FIG. 7. The test consisted of lowering the air pressure at the nozzle outlet 26 and measuring the air pressure differential (indicated by Delta P) between the nozzle inlet 22 and the nozzle outlet 26, and measuring the corresponding pressure at the throat 42 (indicated by the Pressure Ratio). The Pressure Ratio is the ratio of the air pressure at the throat 42 to the air pressure at the nozzle inlet 22. During the test, the air pressure at the nozzle inlet 22 was atmospheric or approximately 101 kPa. The results of FIG. 7 indicate that sonic air flow was achieved in the nozzle passage 18 at an air pressure differential of approximately 5.95 in. (15.1 cm) Hg. This air pressure differential corresponded to a pressure ratio of 0.67 and an air pressure at the nozzle outlet 26 of approximately 68 kPa.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The embodiments of the invention in which an exclusive property of privilege is claimed are defined as follows:

1. A fuel injection assembly for an engine comprising a fuel injector having an injector outlet, a nozzle having a nozzle passage with a nozzle inlet and outlet, said nozzle passage including a converging portion adjacent said nozzle inlet and a diverging portion adjacent said nozzle outlet, said converging and diverging portions being disposed between said nozzle inlet and outlet, and a nozzle support for attaching said nozzle to said fuel injector so that said injector outlet registers with said nozzle passage adjacent said nozzle inlet enabling injection of fuel from said fuel injector into said nozzle passage and so that said nozzle is supported solely by said fuel injector, said nozzle having a nozzle port adjacent said nozzle inlet enabling the establishment of an air flow which enters said nozzle passage adjacent said nozzle inlet and exits said nozzle passage through said nozzle outlet, said converging portion being disposed between said nozzle port and diverging portion, at least a portion of the air flow in said nozzle passage being sonic enabling the fuel injected into said nozzle passage to mix with said sonic air flow and be carried by it through said nozzle passage and said nozzle outlet.

2. A fuel injection assembly for an engine as set forth in claim 1 wherein the air pressure adjacent said nozzle outlet is at least approximately 5.95 in. (15.1 cm) Hg. below the air pressure adjacent said nozzle inlet.

3. A fuel injection assembly as set forth in claim 1 wherein said nozzle passage has a throat between said converging portion and said diverging portion.

4. A fuel injection assembly as set forth in claim 1 wherein the thickness of said nozzle is reduced adjacent said nozzle outlet so that a pointed outlet edge is formed on the end of said nozzle adjoining said nozzle outlet.

5. A fuel injection assembly for an engine comprising a fuel injector having an injector outlet, a nozzle having a nozzle passage with a nozzle inlet and outlet, said nozzle passage including a converging portion adjacent said nozzle inlet and a diverging portion adjacent said nozzle outlet, and a nozzle support for attaching said nozzle to said fuel injector so that injector outlet registers with said nozzle passage adjacent said nozzle inlet enabling injection of fuel from said fuel injector into said nozzle passage, said nozzle having a nozzle port adjacent said nozzle inlet enabling the establishment of an air flow which enters said nozzle passage adjacent said nozzle inlet and exits said nozzle passage through said nozzle outlet, at least a portion of the air flow in said nozzle passage being sonic enabling the fuel injected into said nozzle passage to mix with said sonic air flow and be carried by it through said nozzle passage and said nozzle outlet, wherein said nozzle has longitudinal legs adjacent said nozzle inlet, said legs engaging said fuel injector adjacent said injector outlet to form longitudinal slots, each of said longitudinal slots defining a nozzle port.

6. A fuel injection assembly for an engine comprising a fuel injector having an injector outlet, a nozzle having a nozzle passage with a nozzle inlet and outlet, said nozzle passage including a converging portion adjacent said nozzle inlet and a diverging portion adjacent said nozzle outlet, and a nozzle support for attaching said nozzle to said fuel injector so that said injector outlet registers with said nozzle passage adjacent said nozzle inlet enabling injection of fuel from said fuel injector into said nozzle passage, said nozzle having a nozzle port adjacent said nozzle inlet enabling the establishment of an air flow which enters said nozzle passage adjacent said nozzle inlet and exits said nozzle passage through said nozzle outlet, at least a portion of the air flow in said nozzle passage being sonic enabling the fuel injected into said nozzle passage to mix with said sonic air flow and be carried by it through said nozzle passage and said nozzle outlet, wherein said nozzle support comprises a cylindrical support flange extending axially from said fuel injector adjacent said injector outlet, said support flange being adapted to surround the portion of said nozzle including said nozzle port, said support flange having a flange port allowing air to flow into said nozzle port.

7. A fuel injection assembly as set forth in claim 6 wherein said nozzle has external threads and said support flange has corresponding internal threads enabling said nozzle to be screwed into said support flange.

8. A fuel injection assembly as set forth in claim 7 wherein said flange port is formed by a circumferential slot in said support flange.

9. A fuel injection assembly for an engine comprising a fuel injector having an injector outlet, a nozzle having a nozzle passage with a nozzle inlet and outlet, said nozzle passage including a converging portion adjacent said nozzle inlet and a diverging portion adjacent said nozzle outlet, and a nozzle support for attaching said nozzle to said fuel injector so that said injector outlet registers with said nozzle passage adjacent said nozzle inlet enabling injection of fuel from said fuel injector into said nozzle passage, said nozzle having a nozzle port adjacent said nozzle inlet enabling the establishment of an air flow which enters said nozzle passage adjacent said nozzle inlet and exits said nozzle passage through said nozzle outlet, at least a portion of the air flow in said nozzle passage being sonic enabling the fuel injected into said nozzle passage to mix with said sonic air flow and be carried by it through said nozzle passage and said nozzle outlet and in combination with a socket in the engine, said nozzle support being inserted into said socket, said socket having a sufficiently large interior to form a cavity adjacent said nozzle port, and a cavity inlet in the engine allowing air to flow into said cavity.

10. A fuel injection assembly as set forth in claim 9 wherein the longitudinal axis of said cavity inlet is oblique with respect to the longitudinal axis of said nozzle passage.

11. A fuel injector nozzle for an engine comprising a nozzle having a nozzle passage with a nozzle inlet and outlet, said nozzle passage including a converging portion adjacent said nozzle inlet and a diverging portion adjacent said nozzle outlet, said converging and diverging portions being disposed between said nozzle inlet and outlet, said nozzle being adapted for attachment to a fuel injector having an injector outlet so that the injector outlet registers with said nozzle passage adjacent said nozzle inlet enabling injection of fuel from the fuel injector into said nozzle passage and so that said nozzle is supported solely by the fuel injector, said nozzle having a nozzle port adjacent said nozzle inlet enabling the establishment of an air flow which enters said nozzle passage adjacent said nozzle inlet and exits said nozzle passage through said nozzle outlet, said converging portion being disposed between said nozzle port and diverging portion, at least a portion of the air flow in said nozzle passage being sonic enabling the fuel injected into said nozzle passage to mix with said sonic air flow and be carried by it through said nozzle passage and said nozzle outlet.

12. A fuel injector nozzle for an engine as set forth in claim 11 wherein the air pressure adjacent said nozzle outlet is at least approximately 5.95 in (15.1 cm) Hg. below the air pressure adjacent said nozzle inlet.

13. A fuel injector nozzle as set forth in claim 11 wherein said nozzle passage has a throat between said converging and diverging portions.

14. A fuel injector nozzle as set forth in claim 11 wherein the thickness of said nozzle is reduced adjacent said nozzle outlet so that a pointed outlet edge is formed on the end of said nozzle adjoining said nozzle outlet.

15. A fuel injector nozzle for an engine comprising a nozzle having a nozzle passage with a nozzle inlet and outlet, said nozzle passage including a converging portion adjacent said nozzle inlet and a diverging portion adjacent said nozzle outlet, said nozzle being adapted for attachment to a fuel injector having an injector outlet so that the injector outlet registers with said nozzle passage adjacent said nozzle inlet enabling injection of fuel from the fuel injector into said nozzle passage, said nozzle having a nozzle port adjacent said nozzle inlet enabling the establishment of an air flow which enters said nozzle passage adjacent said nozzle inlet and exits said nozzle passage through said nozzle outlet, at least a portion of the air flow in said nozzle passage being sonic enabling the fuel injected into said nozzle passage to mix with said sonic air flow and be carried by it through said nozzle passage and said nozzle outlet, wherein said nozzle has longitudinal legs adjacent said nozzle inlet, said legs being engageable with the fuel injector adjacent its outlet to form longitudinal slots, each of said longitudinal slots defining a nozzle port.

16. A fuel injector for an engine, said fuel injector having an injector outlet and an integral cylindrical support flange extending axially from said fuel injector adjacent said injector outlet, said support flange being adapted to hold a portion of a nozzle adjacent said injector outlet so that it registers with a nozzle passage in the nozzle enabling injection of fuel from the fuel injector into the nozzle passage, said support flange being further adapted to surround the portion of the nozzle having a nozzle port leading to the nozzle passage, said support flange having a flange port allowing air to flow into said nozzle port.

17. A fuel injector as set forth in claim 16 wherein said flange port is formed by a circumferential slot in said support flange.

18. A fuel injector as set forth in claim 16 wherein said support flange has internal threads corresponding to external threads on the portion of the nozzle held in said support flange enabling the nozzle to be screwed into said support flange.

* * * * *